United States Patent [19]

Mueller

[11] 4,140,938

[45] Feb. 20, 1979

[54] GAS DISCHARGE LAMPS FOR DC OPERATION HAVING A DOUBLE ELECTRODE ARRANGEMENT AND A DISCHARGE-TIGHT CROSS CONNECTION OF THE ELECTRODE SPACES

[75] Inventor: Gerd Mueller, Mainz-Weisenau, Fed. Rep. of Germany

[73] Assignee: JENAer Glaswerk Schott & Gen., Fed. Rep. of Germany

[21] Appl. No.: 860,446

[22] Filed: Dec. 14, 1977

[30] Foreign Application Priority Data

Dec. 15, 1976 [DE] Fed. Rep. of Germany ..... 2656776

[51] Int. Cl.[2] ..... H01J 61/04; H01J 61/30; H01J 61/36

[52] U.S. Cl. ..... 313/204; 313/220

[58] Field of Search ..... 313/493, 485, 220, 190, 313/204

[56] References Cited

U.S. PATENT DOCUMENTS

| | | | |
|---|---|---|---|
| 3,117,248 | 1/1964 | Lake | 313/220 X |
| 3,689,793 | 9/1972 | Walz | 313/220 |

FOREIGN PATENT DOCUMENTS

| | | | |
|---|---|---|---|
| 2319401 | 11/1974 | Fed. Rep. of Germany. | |
| 957958 | 5/1964 | United Kingdom | 313/493 |

*Primary Examiner*—Palmer C. Demeo

*Attorney, Agent, or Firm*—Hill, Gross, Simpson, Van Santen, Steadman, Chiara & Simpson

[57] ABSTRACT

A gas discharge lamp is disclosed for DC operation which has a double electrode arrangement and a discharge-tight cross connection between electrode spaces. Discharge spaces for the electrodes are provided within a glass envelope. An electrode member in the envelope includes an electrical insulating disk with a central continuous interior bore having two electrodes therein and one or two side bores formed from a periphery of the disk to the interior bore. The side bores accommodate pumping connecting pieces and input lines connected to the electrodes. The interior bore is subdivided by a gas-permeable discharge-tight diaphragm positioned between the two electrodes. Exterior surfaces of the disk are provided with glass solder for joining with face surfaces of the envelope.

11 Claims, 3 Drawing Figures

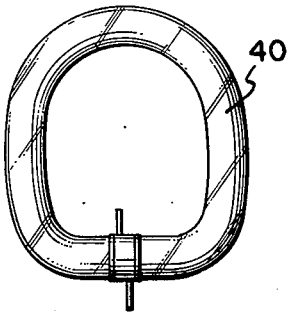
FIG. 1A
FIG. 1
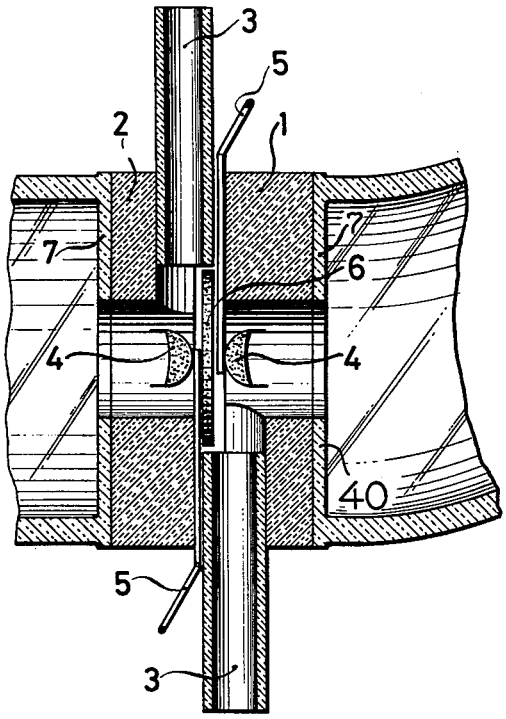
FIG. 2
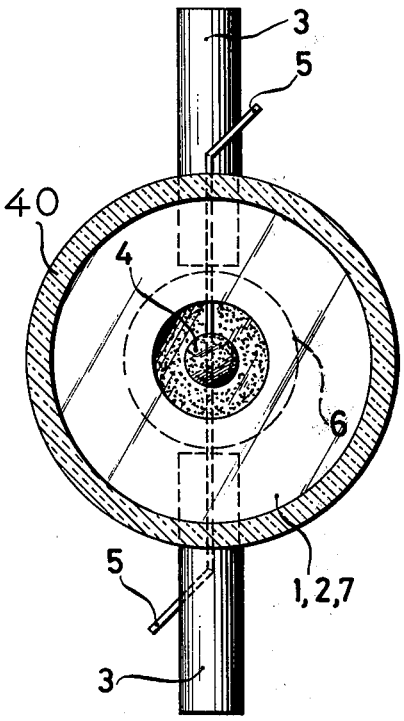

GAS DISCHARGE LAMPS FOR DC OPERATION HAVING A DOUBLE ELECTRODE ARRANGEMENT AND A DISCHARGE-TIGHT CROSS CONNECTION OF THE ELECTRODE SPACES

BACKGROUND OF THE INVENTION

The subject of the invention is a gas discharge lamp for DC operation having a double electrode arrangement and a discharge-tight cross connection of the electrode spaces. The electrode spaces are separated by means of a formed part and are hermetically sealed from surrounding areas via a solder glass seal.

It is principally known that the light yield from gas discharge lamps can be increased when the gas discharge lamps are operated with DC instead of AC current. Lately, a number of embodiments of gas discharge lamps for DC operation have been suggested (for example, German Pat. Nos. 2,254,709 and 2,319,401).

Essential characteristics of this known embodiment is that the lamp shape is structured such that the two electrodes are closely adjacent and that the two electrode spaces are gas or metal vapor permeable but are connected in discharge-tight fashion with one another in order to avoid a dropping of the light yield during the operation due to cataphoresis phenomenona. In accordance with the German Pat. No. 2,319,401, these characteristics are obtained by use of an almost closed shape of the tube-shaped discharge space and by means of a capillary connection or a porous diaphragm such as, for example, one consisting of sintered glass wool.

Such a structure deviates considerably from the stretched shape of fluorescent tubes and therefore also requires another construction technique. The principal advantage of an increased light yield can therefore only be economically realized when the production expense does not greatly exceed the conventional expense of fluorescent tubes for AC current operation.

It is therefore an object of the present invention to produce a gas discharge tube having a structure which is suitable for DC current operation and which can be mass produced. The constructions presently suggested in the above-named letters patent and also in the article by A. Walz "Tests Relating to the Question of Possible Efficiency Degree Improvements in Electric Light Sources", (Magazine for Light Technique, in print) do this requirement justice only to a limited degree as they either require the building in of a complicated shaped electrode arrangement by a glass blower or they require the hermetically sealed connection of large-area glass parts and tube parts via a glass soldering technique which can only be produced under extreme difficulties when the glass solder is applied and the parts are positioned during the solder process, as experience has shown.

A discharge lamp suitable for DC operation essentially consists of a formed glass tube with an almost closed shape, said tube comprising the discharge space filled with the operating gas and/or the metal vapor and also the electrodes with their electrical inputs, two in the case of heated electrodes or one in the case of cold electrodes. They are conveyed in gas-tight manner through the glassy wall of the discharge space. Furthermore, one or more openings in the form of bored connecting pieces are expediently mounted in the vicinity of the electrodes. These bored connecting pieces are used for evacuating and filling the tubes with the operating gas and are melted off after the filling.

The nearly closed form of the gas discharge space for DC operation is required because the ions produced in the gas discharge wander towards the cathode in the direction of the electrical field cataphoresis and thereby effect a dropping of the light yield in long-time operation. If this effect is to be prevented without additional electrical or electronic expense, the anode and cathode spaces must have a connection which facilitates an exchange of the concentration differences formed by means of the cataphoresis. The connection has to be discharge-tight. This is obtained in the known manner by means of a small ratio between cross section and length in a capillary, or by means of a fiber felt. Accordingly the compound is not adulterated, for example, in the case of mercury vapor tubes, since the compound has to be held at a sufficiently high temperature during the operation of the lamp. This is most readily obtained by means of the spatial proximity of the connection to the electrodes. The nearly closed form of the electrode spaces therefore results.

SUMMARY OF THE INVENTION

In accordance with the invention, the discharge tubes are composed of a few efficiently prefabricated components which are joined into a tube in one operating process. One of the components is the discharge tube which is formed into a nearly closed shape whose open ends are opposite one another at a slight distance and have a parallel cross-sectional surface. The distance of the tube ends is smaller than or comparable to the diameter of the discharge tube. The remaining essential components of the tube are constructed as one compact, efficiently prefabricated component in accordance with the invention. This component, subsequently also called an electrode member, consists of an electrically insulating disk having a central, continuous interior bore hole and cross bore holes which lead from the periphery of the disk to the interior bore hole. At least one pumping connecting piece is accommodated in corresponding cross bore holes and projects therefrom. The electrode input lines are conveyed through corresponding cross bore holes having a small cross-section. A diaphragm is provided which is unaffected by changes of temperature, is electrically insulating, is discharge tight, is gas-permeable, and subdivides the continuous interior bore hole.

The assembly of the tube results with the aid of a glass solder technique, per se known, whereby a gas-tight connection need only be produced between the parallel frontal surfaces of the discharge tube and the frontal surfaces of the above-described disk of the electrode member. There, the frontal surfaces of the disk and/or of the discharge tube must be layered with glass solder in the known manner. Expediently, this layering results only at the side of the disk for better handling ease. There, the solder coating can also be integrated into the production process of the electrode member. For sealing it is expedient to select the thickness of the electrode member disk including the solder glass coating by a sufficiently larger amount than the spacing of the frontal surface of the discharge tube so that the electrode member can be elastically clamped between the shanks of the discharge tube without danger of breaking. A secure sealing of the solder surfaces is effected by means of the elastic restoring force after heating and softening of the solder glass, for example, in a continuous heating furnace. Certainly, the elastic forces, particularly in very long discharge tubes, can be supported by means of mechanical loading of the tube legs with the aid of weights or springs or can even be replaced.

The electrode member is expediently constructed with the aid of formed members which are produced from glass or ceramics in accordance with the sintering technique. An example for one embodiment of the electrode component is explained in the drawing with the utilization of instant start electrodes having only one respective input line.

BRIEF DESCRIPTION OF THE DRAWINGS

FIG. 1 illustrates a vertical section through the electrode member;

FIG. 1A illustrates the glass discharge tube and connected electrode member of FIG. 1; and FIG. 2 illustrates a side view of the electrode member.

DESCRIPTION OF THE PREFERRED EMBODIMENTS

Reference numerals 1 and 2 are disks having an interior bore and one large and one small radial slit, respectively, in order to accommodate the pumping connecting piece or the inlets of the two electrodes 4 positioned on both sides of the diaphragm plate 6. The interior bores of the disks 1 and 2 are arranged at the side of the disks, facing one another, such that they accommodate the diaphragm plate 6, whose diameter is somewhat larger than the continuous interior bore of the disks 1 and 2. On the exterior side, the two disks 1 and 2 are coated with solder glass 7. The disks 1 and 2 can advantageously be pressed and sintered from ceramic raw materials or from glass powder in accordance with the dry press method. The additional, gas-tight assembly of the parts results with the aid of the solder glass technique (soldering-in of the pumping, connecting pieces and the electrode input lines, and soldering together the two disks 1 and 2 including the diaphragm 6). The electrode member is placed between the open ends 40 of a tubular glass member of almost closed shape.

When using a sinter glass which has a sufficiently low melting temperature, the parts can also be directly connected and sealed by means of melting the sinter glass disks with one another and with the pumping connecting pieces and the electrode input lines in one carbon mold. The solder glass layer 7 can also be obtained in a simple manner, for example, by means of immersing the frontal sides of the electrode member into a solder glass powder suspension with a subsequent sintering in of the solder glass powder.

A preferred embodiment of the invention consists in that the disks 1 and 2 are themselves sintered from solder glass powder. In that case, the melting together of the disks 1 and 2 and also the melting-in and sealing of the pumping connecting pieces and the electrode input lines is possible in a melting form at particularly low temperatures, and an additional solder glass layering for the connection with the legs of the U-tube is not required. When the subsequent heating of the discharge tube or the melting-off of the pumping connecting pieces demands a higher temperature stability of the electrode member than solder glasses normally possess, the temperature stability can be obtained by means of employing crystalizing solder glasses, known per se.

It is obvious that the relative position of the pumping connecting pieces and the electrode input lines can be varied vis-a-vis the illustration in FIG. 1. The disks 1 and 2 can also be differently or additionally divided without altering the essence and function of the electrode member. A division into three disks can, for example, be advantageous when a larger distance between the electrodes in relation to the diaphragm is strived for.

In FIG. 1, the bores for the pumping connecting pieces and the electrode passages lie adjacent to one another. Of course, the bores can also be arranged separately. It is also possible to convey the electrode input lines 5 through the pumping connecting pieces per se and to seal them with a pressure seal after the pumping and filling process.

The production of the electrode member of this invention can easily be carried out for all process steps without great expense and for great numbers of components. In particular, all glass-blower and glass-melting operating processes do not have to be performed in front of an open flame. The assembly of the electrode member with the discharge tube is also greatly facilitated in relation to existing cataphoresis free discharge lamps since no work operations in front of the flame are necessary. Moreover, the total surface to be connected and to be sealed is minimal in this work operation in which the generally bulky discharge tube is involved, and the positioning of the parts to be connected is very simple by use of elastic restoring forces.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A gas discharge lamp for DC operation which has a double electrode arrangement and a discharge-tight cross-connection between electrode spaces, comprising:

(a) a partially tube shaped discharge space envelope formed in a substantially closed manner such that at least two open ends are provided opposite one another at a short distance and having face surfaces parallel to one another;

(b) a separate electrode member means for glass solder connection to the open ends of the envelope comprising:

(i) an electrically insulating disk means with a central continuous interior bore therethrough having two electrodes therein and at least one side bore formed from a periphery of the disk means to said interior bore;

(ii) said side bore including a wide portion accommodating a pumping connecting piece and a narrower portion accommodating at least one input line connected to one of the two electrodes;

(iii) said interior bore being subdivided by a gas-permeable discharge-tight diaphragm positioned between the two electrodes at a location of the side bore; and (iv) exterior surfaces of the disk being provided with glass solder for joining with face surfaces of the envelope.

2. The lamp of claim 1 in which two side bores are provided, each accommodating a pumping connecting piece and an electrode input line, and each of said glass envelope open ends accommodates one of said pumping connecting pieces.

3. A gas discharge lamp in accordance with claim 1, characterized in that a seal between the electrically insulating disk means, the pumping connecting piece and the electrode input lines comprises glass solder.

4. A gas discharge lamp in accordance with claim 1, characterized in that the disk means comprises a lower softening point sintered glass with respect to the pumping connecting piece and material of the diaphragm, and seals to the pumping connecting piece and the electrode input line comprise the sintered glass.

5. A gas discharge lamp in accordance with claim 1, characterized in that the electrically insulating disk means comprises a sintered solder glass, and seals to the pumping connecting piece, to the frontal sides of the discharge envelope, and the electrode input line comprise solder glass.

6. A gas discharge lamp in accordance with claim 1, characterized in that the electrically insulating disk means is subdivided into at least two disks which have radial recesses which form the side bore in order to accommodate the pumping connecting piece and the electrode input lines, seals between the disks being provided by solder glass.

7. A gas discharge lamp in accordance with claim 6, characterized in that the two disks provided each have an interior bore, and the diaphragm has a diameter larger than a diameter of the interior bore.

8. A gas discharge double electrode lamp for DC operation having a gas permeable but discharge tight connection between electrode spaces, comprising:

(a) an envelope;

(b) a separate electrode member means for glass solder connection to the envelope, comprising:

(i) an electrically insulating disk means with a central continuous interior bore therethrough and first and second side bores;

(ii) said interior bore being subdivided by a gas-permeable discharge-tight diaphragm between and at a location of the offset side bores;

(iii) an electrode on each side of the diaphragm in the interior bore, each electrode having an input line; and (iv) a pumping connecting piece in each of said offset side bores.

9. The lamp of claim 8 in which each of said side bores includes one of said input lines.

10. The lamp of claim 8 in which said side bores are offset such that they exit at opposite surfaces of the diaphragm.

11. The lamp of claim 8 in which the interior bore has substantially the same diameter through the insulating disk means.

* * * * *